United States Patent [19]

Syroka et al.

[11] 4,141,997

[45] Feb. 27, 1979

[54] MULTI-COMPARTMENT COFFEE STEEPING BAG AND SUPPORT CLIP THEREFOR

[76] Inventors: Edward C. Syroka; Bernice A. Syroka, both of 123 A Lincoln Ave., Saugus, Mass. 01906

[21] Appl. No.: 726,759

[22] Filed: Sep. 27, 1976

[51] Int. Cl.[2] ..... B65B 29/02; A47G 19/16

[52] U.S. Cl. ..... 426/79; 24/261 R; 99/321; 99/323; 206/0.5; 210/469; 426/82

[58] Field of Search ..... 426/77–84; 206/0.5; 215/101; 24/261 R, 261 A, 261 B, 261 GC, 261 G; 210/469; 99/321, 322, 323; D8/395

[56] References Cited

U.S. PATENT DOCUMENTS

| | | | |
|---|---|---|---|
| 184,626 | 11/1876 | Jewett | 24/261 A |
| 256,231 | 4/1882 | Mackey | 99/321 |
| 510,835 | 12/1893 | Blair | 24/261 A |
| 634,349 | 10/1899 | Humphrey | 426/82 |
| 844,906 | 2/1907 | Adams | 210/469 |
| 1,314,998 | 9/1919 | Witt | 24/261 GC |
| 1,424,740 | 8/1922 | Schweinert | 215/101 |
| 2,019,380 | 10/1935 | Andrews | 24/261 GC |
| 2,106,453 | 1/1938 | Ekdahl | 210/469 |
| 2,357,063 | 8/1944 | Swing | 210/469 |
| 2,419,092 | 4/1947 | Schupbaeh et al. | 24/261 R |
| 2,591,606 | 4/1952 | Reed | 210/469 |
| 2,744,631 | 5/1956 | Toombs | 210/469 |
| 2,786,761 | 3/1957 | Weisman | 426/77 |
| 2,791,505 | 5/1957 | Barnett | 426/79 |
| 2,793,120 | 5/1957 | Bennett | 426/79 |
| 2,891,867 | 6/1959 | Irmscher | 426/83 |
| 2,954,294 | 9/1960 | Whelan | 426/79 |
| 3,223,229 | 12/1965 | Welin-Berger | 426/79 |
| 3,387,978 | 6/1968 | Major | 426/80 |
| 3,657,994 | 4/1972 | Post | 99/323 |
| 3,692,536 | 9/1972 | Fant | 426/83 |
| 3,895,118 | 7/1975 | Rambold | 426/82 |

FOREIGN PATENT DOCUMENTS

| | | | |
|---|---|---|---|
| 24151 of | 1904 | United Kingdom | 426/79 |

OTHER PUBLICATIONS

Tea & Coffee Trade J. pp. 39, 41, 1/53.

*Primary Examiner*—Steven L. Weinstein
*Attorney, Agent, or Firm*—Clarence A. O'Brien; Harvey B. Jacobson

[57] ABSTRACT

A double compartment bag constructed of flexible porous material for containing a beverage infusion commodity is provided. The bag includes a pair of independent infusion commodity compartments with the compartments defined in opposited halves of a rectangular bag. A central median portion of the bag separates the compartments from each other and defines a line along which the bag may be folded in half. An inverted U-shaped resilient clip is also provided including short and long legs, and the short leg of the clip includes structure defining a finger engageable tab. The clip is engaged with the bag having its long leg extending along the aforementioned median portion of the bag on the side thereof defining the included angle of the bag when it is folded and the short leg of the clip is engaged over the outer surface of a cup into which the bag is placed. The clip clamps the median portion of the bag between the long leg of the clip and the opposing inner surfaces of the wall of the cup engaged by the clip and the latter serves to clamp the bag against the wall of the cup on the interior thereof closely above the bottom of the cup.

4 Claims, 4 Drawing Figures

Fig. 1
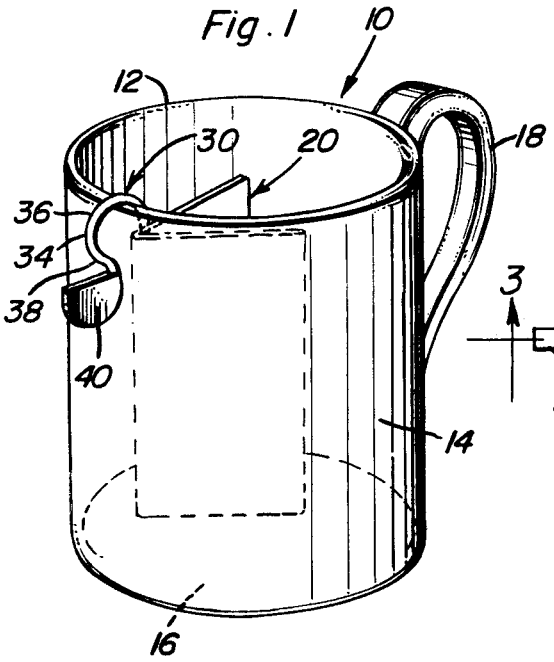
Fig. 2
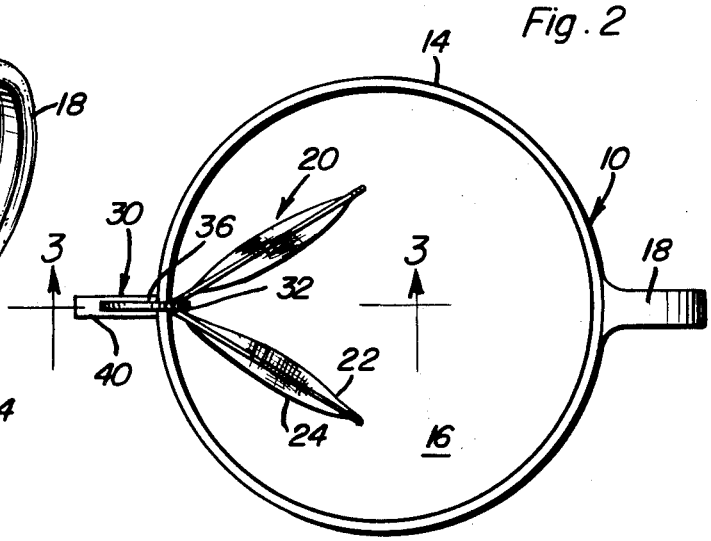
Fig. 3
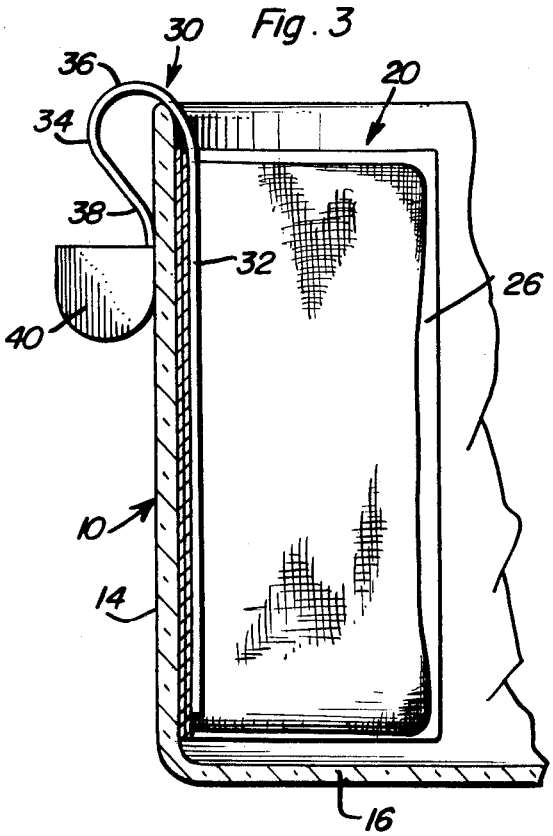
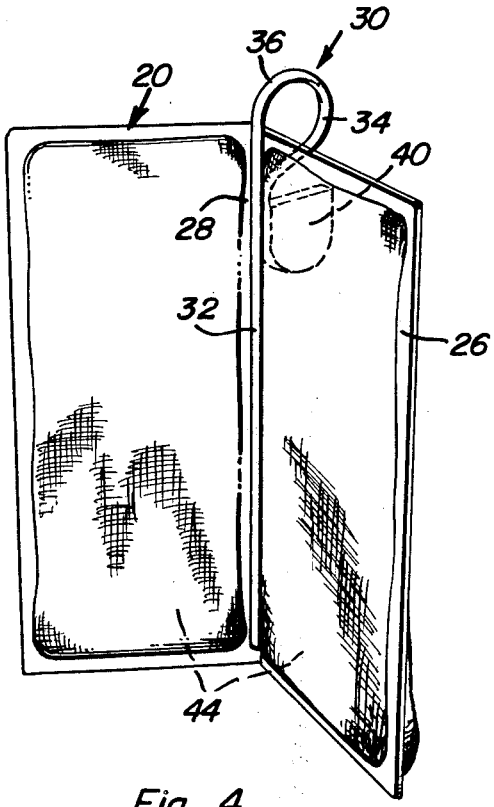
Fig. 4

MULTI-COMPARTMENT COFFEE STEEPING BAG AND SUPPORT CLIP THEREFOR

BACKGROUND OF THE INVENTION

Various forms of multi-compartment bags for beverage infusion commodities have been heretofore designed and various apparatuses have also been designed to support beverage infusion commodity bags within a cup or the like. However, most multi-compartment bags are reasonably complex in structure or rely upon a string or strings attached thereto in order to withdraw the bag from an associated cup. Further, the various structures heretofore provided for supporting a beverage infusion commodity bag within a cup or the like have also been reasonably complex in nature. Accordingly, a need exists for a simplified double compartment beverage infusion commodity bag and for structure capable of moving the bag into proper position within a cup or the like stationarily supporting the bag in proper position and for thereafter facilitating removal of the bag from the cup.

Examples of beverage infusion commodity bags and structures for support thereof including some of the general structural and operational features of the instant invention are disclosed in U.S. Pat. Nos. 2,791,505, 2,793,120, 2,805,164, 2,891,867, 3,387,978, 3,597,222 and 3,607,302.

BRIEF DESCRIPTION OF THE INVENTION

The multi-compartment coffee steeping bag of the instant invention is generally rectangular in configuration and includes a longitudinal median portion thereof defining a divider between two interior compartments of the bag and along which the bag may be folded. The bag is otherwise without attachments therefor and thus may be readily manufactured at a low cost. The clip for support of the partially folded bag within a cup or the like is generally U-shaped in configuration including a long leg for engagement with the folded median portion of the bag and a short leg for engagement over the outer surface of the wall of the cup against which the bag is clamped by means of the clip. In addition, the short leg of the clip includes a finger engageable tab for facilitating placement of the clip in position with the bag disposed in an associated cup and for removal of the clip and the bag from the cup after a beverage has been prepared within the cup.

The main object of this invention is to provide a double compartment beverage infusion commodity bag which is free of attachments directly connected thereto and which therefore may be manufactured at a low cost.

Another object of this invention is to provide a clip for removable support of the double compartment beverage infusion commodity bag within a cup or the like while a beverage is being produced therein.

A still further object of this invention is to provide a clip in accordance with the preceding object and which may be used repeatedly and thereby enables a plurality of perhaps fifty or one hundred bags of the instant invention to be marketed in a single package containing a lesser number of reusable clips for support of the bags within cups in which beverages are to be made.

A final object of this invention to be specifically enumerated herein is to provide a multi-compartment coffee steeping bag and support clip therefor which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a beverage cup with a beverage infusion commodity bag constructed in accordance with the present invention supported therein by means of the bag supporting clip portion of the instant invention;

FIG. 2 is a top plan view of the assemblage illustrated in FIG. 1;

FIG. 3 is an enlarged fragmentary sectional view taken substantially upon the plane indicated by the section 3—3 of FIG. 2; and FIG. 4 is a perspective view of the bag and clip in assembled relation immediately prior to the bag being placed within a cup and the clip being engaged with the wall of the cup against which the bag is to be clamped.

DETAILED DESCRIPTION OF THE INVENTION

Referring now more specifically to the drawings the numeral 10 generally designates a conventional form of coffee cup including a cylindrical body 12 having a cylindrical side wall 14 and a bottom 16. The cup 10 also includes a lifting handle 18.

The double compartment bag of the instant invention is referred to in general by the reference numeral 20 and is specifically designed for use in containing fresh ground coffee. The bag includes opposite side panels 22 and 24 secured together in registered relation about the entire periphery of the bag as at 26. In addition, the bag 20 includes a median portion 28 extending from one side thereof to the opposite side along which the panels 22 and 24 are also secured together. The median portion 28 therefore divides the interior of the bag 20 into two separate compartments and it is to be noted that the bag 20 is constructed of flexible porous material. The two compartments of the interior of the bag 20 each have approximately one-and-a-half teaspoons of fresh ground coffee disposed therein, whereby a total of one tablespoon of fresh ground coffee is contained in each bag.

Double compartment bags have heretofore been used for the purpose of containing a beverage infusion commodity. However, most of these double compartment bags are provided with attachments whereby the bags may be lowered into a cup such as the cup 10 and may be withdrawn from the cup after which the desired beverage has been produced and these attachments do not serve to maintain the bag below the surface of the beverage being formed in the cup 10 with the result that the bags may float to the top of the liquid within the cup. When the bag floats to the top of the liquid, the beverage produced is either weak or the brewing time must be considerably extended.

A clip referred to in general by the reference 30 is provided and includes a long leg 32 and a short leg 34. The legs 32 and 34 generally parallel each other and are interconnected at corresponding upper ends by means of an integral bight portion 36. The clip 30 is constructed of a stiff but resilient material and it may be seen from FIG. 3 of the drawings that the short leg 34 includes a reversely bent free end portion 38 provided with a finger engagable tab 40.

The clip 30 is generally used in a position whereby the legs 32 and 34 depend downwardly from the bight portion 36 and the bag 20 is initially engaged, along the median portion 28 thereof, by the long leg 32 around which the bag 20 is folded into a generally V-shaped configuration such as that illustrated to advantage in FIG. 2. The long leg 32 is disposed over that portion of the median portion 28 defining the apex of the included angle formed by the bag 20 and the short leg 34 engages the opposite side of the median portion 28. Thereafter, the finger engagable tab 40 may be grasped and the bag 30 may be lowered into the cup 10 with the free end of the leg 32 frictionally engaged with the lower portion of the bag 20 and thereby utilized to guide the lower median portion of the bag 20 downwardly along the inner surface of the side wall 14 of the cup 10. As the tab 40 is lowered into close proximity with the upper marginal portion of the side wall of the cup 14, the tab 40 is slightly outwardly displaced so as to pass below the upper marginal edge of the side wall 14 of the cup 10 on the exterior of the latter. Thus, the clip 30 serves to maintain the bag 20 clamped against the inner surface of the side wall 14 of the cup 10. Of course, the two halves of the bag disposed on opposite sides of the median portion 28 are subject to penetration by the liquid within the cup 10 from opposite sides thereof and the coffee 44 within the two compartments of the bag 20 may be properly steeped in order to produce a fresh, single cup unit of brewed coffee which is comparable to perked coffee.

It will be noted that the bag 20 may be readily formed and filled by conventional processes and that the bag 20 is free of direct attachments thereto. Accordingly, the bag 20 may be inexpensively produced. Also, inasmuch as the clip 30 is reusable, a plurality of perhaps fifty or one hundred bags 20 may be packaged in a single container together with a considerably lesser number of reusable clips 30.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A beverage infusion package comprising a bag of flexible porous material and consisting of a pair of registered opposite side panels including corresponding first and second pairs of opposite side marginal edges, said panels being secured together along said first and second pairs of opposite side marginal edges, and registered straight median portions of said panels extending between the first pairs of opposite side marginal edges of said panels being secured dividing the interior of said bag into two separate compartments, said straight median portions of said panels defining fold zones thereof along which said bag may be folded, each of said compartments having a quantity of beverage infusion commodity therein, said bag being free of attachments directly connected thereto, a reuseable spring support clip including side-by-side long and short legs connected together at one pair of corresponding ends thereof by connecting structure extending therebetween, said long leg being removably engaged over and extending along the side of said median portions defining the included angle formed by said bag when folded along said median portions and said short leg being adapted to extend downwardly along the outer side of a beverage container side wall against whose inner surface said median portions of said panels are clamped by said long legs, said connecting structure comprising a curved bight portion formed integrally with said one pair of ends of said legs, said curved bight portion defining a single smoothly curved arcuate section of substantially 180° extent and whose ends merge smoothly into said one pair of ends of said legs, said short leg including base and free end portions adjacent and remote from the corresponding end of said arcuate section and a reversely curving portion intermediate and integral with said base and free end portions offsetting said free end portion relative to said base end portion into close juxtaposition relative to the adjacent side of said long leg.

2. The combination of claim 1 wherein said infusion commodity comprises ground coffee.

3. The combination of claim 2 wherein said ground coffee is "perk ground" and each compartment contains approximately one-and-a-half teaspoons of ground coffee.

4. The combination of claim 1 wherein said panels are rectangular in plan shape and said first pairs of opposite side marginal edges comprise the short marginal edges thereof.

* * * * *